US005099633A

United States Patent [19]

Gombault et al.

[11] Patent Number: 5,099,633

[45] Date of Patent: Mar. 31, 1992

[54] METHOD AND SYSTEM FOR PREPARING ITEMS TO BE MAILED

[75] Inventors: Jacobus F. Gombault, Drachten; Gerhard Hidding, Heerenveen, both of Netherlands

[73] Assignee: Hadewe B.V., Drachten, Netherlands

[21] Appl. No.: 547,228

[22] Filed: Jul. 3, 1990

[30] Foreign Application Priority Data

Jul. 3, 1989 [NL] Netherlands ..... 8901686

[51] Int. Cl.[5] ..... B65B 61/02; B65B 11/48

[52] U.S. Cl. ..... 53/411; 53/460; 53/131.4; 53/284.3

[58] Field of Search ..... 53/411, 460, 131, 209, 53/266 A, 131.4, 284.3

[56] References Cited

U.S. PATENT DOCUMENTS

| | | | |
|---|---|---|---|
| 4,071,997 | 2/1978 | Gunther | 53/209 |
| 4,091,268 | 5/1978 | Jarleton et al. . | |
| 4,312,169 | 1/1982 | Goucz | 53/206 |
| 4,343,129 | 8/1982 | Gunther | 53/209 |
| 4,397,542 | 8/1983 | Brodesser . | |
| 4,699,731 | 2/1987 | Zangheri | 53/411 |
| 4,733,856 | 3/1988 | Gunther | 53/266 A |
| 4,739,606 | 4/1988 | Cantile | 53/131 X |
| 4,787,192 | 11/1988 | Gunther | 53/209 |
| 4,800,505 | 1/1989 | Axelrod et al. . | |
| 4,835,544 | 5/1989 | Winterburn . | |

FOREIGN PATENT DOCUMENTS

| | | |
|---|---|---|
| 0265192 | 4/1988 | European Pat. Off. . |
| 2612456 | 9/1988 | France . |
| 7604393 | 10/1976 | Netherlands . |
| 2202660 | 9/1988 | United Kingdom . |

*Primary Examiner*—John Sipos

*Attorney, Agent, or Firm*—Burns, Doane, Swecker & Mathis

[57] ABSTRACT

A method of preparing items to be mailed, in which periodically at least one main document is inserted into an envelope by way of a mail preparation system comprising an inserter station. A printing is printed through use of a printer on an envelope, which printing corresponds to a given main document. In accordance with the invention the printed envelope is fed from the printer to the inserter station, where the given main document is inserted into the printed envelope that corresponds to that main document. Furthermore a system for preparing items to be mailed comprises a printer, an envelope supply path and an inserter station connected thereto. In accordance with the invention the printer (6) is connected to the envelope supply path (5), in such a way that the envelopes can be fed from the printer (6) along the envelope supply path (5) to the inserter station (2).

20 Claims, 1 Drawing Sheet

METHOD AND SYSTEM FOR PREPARING ITEMS TO BE MAILED

BACKGROUND OF THE INVENTION

The invention relates to a method of preparing items to be mailed, in which periodically at least one main document is inserted into an envelope by means of a mail preparation system comprising an inserter station, and in which a printing is printed on an envelope by means of a printer, which printing corresponds to a given main document.

Such a method is known from European patent specification 0 265 192, in which the given main document with any enclosures is inserted into an envelope and that envelope is provided with a printing corresponding to that main document.

A problem involved in such a method is the printability of the envelopes which sets limits to the printers that can be used, and to the thickness, the dimensions, and the stability of the documents and enclosures to be inserted into the envelopes. The envelopes have a relatively large thickness which varies with the contents, and the surface to be printed yields to pressure exerted on it, depending on the contents inserted. This problem is enhanced when in a run successive envelopes are to be supplied with different numbers of document sheets and enclosures.

OBJECT AND SUMMARY OF THE PRESENT INVENTION

The object of the invention is to provide a method in which the problem discussed hereinabove is overcome.

This object is attained in virtue of the fact that according to the invention the printed envelope is passed from the printer to the inserter station, where the given main document is inserted into the printed envelope that corresponds to that main document.

The method according to the invention enables the envelopes to be printed while they are empty. Thus the thickness of the envelopes is limited and constant irrespective of the contents to be inserted, which improves the printability considerably. In particular the method permits the use of a laser printer. Matching printed envelopes with the corresponding main documents so as to ensure the main documents are inserted into the proper envelopes, can be reliably controlled on account of the fact that after the printing of the envelope both the given main document and the printed envelope are transported by means of that mail preparation system.

The identification of each envelope can be realized when that envelope is printed and can be maintained by following the envelopes for checking whether the main documents are inserted in the corresponding envelopes. The recognition of envelopes already printed is therefore not necessary.

The method according to the invention does not only enable postal items to be efficiently prepared in long series, but also allows great flexibility in the production, which makes it possible to efficiently prepare items in small numbers or even a single item. Postal items that are to be signed, for instance, can be prepared for despatch except that the envelope is left open, with the envelopes being automatically printed.

As will be clear, information other than the address can also be printed on the envelope when a suitable printer for printing envelopes is used. When suitable protection is provided, printing may include franking.

The preparation of postal items can be further integrated by feeding the given main document from a printer which prints at least a part of that main document. A further advantage thereof is that the information for printing the envelopes depending on the given main document supplied can be generated together with the information for printing that main document, which makes it possible to operate the system for the preparation of postal items by means of a data processor, coupled to the printing of the main document.

Printing envelopes depending on the given main documents supplied may, as is known per se, also be realized by printing the envelope in accordance with marks which are provided on the given main document and are optically scanned.

The fact that in the method according to the invention the envelopes, when being printed, may be of small constant thickness, is an advantage, for instance when the envelopes are to be xerographically printed. This makes it possible to advantageously print envelopes in correspondence with main documents by printing an image on the envelope that is substantially identical to at least a part of an image that is formed by the marks on the main document which are scanned. The advantage is that it is unnecessary to provide specific signs on the envelope intended for determining the printing of the envelope, and that the method can be implemented without communication with apparatus outside the mail preparation system in respect of the printing to be applied to the envelopes. By implication, the method according to this embodiment of the invention does not make any requirements as to the compatibility of the printer and the apparatus referred to.

According to another embodiment of the invention the envelope is printed using the same printer as the one used for printing the given main document. Hence, only one printer is sufficient, and at the same time the communication between the apparatuses used for drawing up the printing codes and the printer is relatively simple.

In further elaboration of the invention the printed envelope and the given main document may, upstream of the inserter station, be guided into different paths and be passed along them to the inserter station, with the envelopes being guided into different paths directly before the envelopes are fed to the inserter station. The fact that a given main document and the corresponding printed envelope are passed along the same path up to a point right before the inserter station ensures that the order of that envelope and that main document, and the order relative to previous and subsequent combinations of particular main documents and the corresponding printed envelopes are readily maintained.

In accordance with an alternative elaboration, the printed envelope and the given main document are also guided into different paths and passed along them to the inserter station, but now the envelope and the given main document are guided into different paths directly after the envelope and that main document are fed from the printer. Thus the envelopes are transported to the inserter station along a substantially separate supply path. The respective supply paths of the envelopes and the documents, therefore, only need to be equipped for the transport of envelopes and documents, respectively, so that they are permitted to be of relatively simple construction. This advantage is particularly important for the document supply path, which is often intended to include processing stations, for instance for adding enclosures and for folding documents.

In further elaboration of the invention, the envelopes are transported in a vertical position. The advantage is that it permits the use of an envelope supply path that takes up little area. A further advantage is that guiding the envelopes in a horizontal direction about the document supply path is simple, on account of the fact that any bends in a horizontal direction can easily be negotiated by the envelopes which are held in a vertical position, and hence are flexible in a horizontal direction.

To maintain the relation between given documents and the corresponding envelopes in the mail preparation system, when an envelope or a document is jammed in the system, it is advantageous for the corresponding main document or the corresponding envelope, respectively, to be identified so that when for instance a document is jammed, the corresponding envelope is not combined with a next main document together with any corresponding documents and enclosures. Such an error could also have an effect on subsequent items to be prepared.

In accordance with a further elaboration of the invention the location of the identified main document or the identified envelope is indicated by the mail preparation system. Thus the operator of the mail preparation system can observe what document or envelope is to be removed to maintain the relation between successive documents and the corresponding envelopes which are located in the preparation system. The jammed document or envelope can in principle be recognized by the condition of that document or envelope.

In accordance with an alternative embodiment, the identified document or the identified envelope is separately removed by the mail preparation system. Accordingly, for the identified document or the identified envelope to be removed, no action on the part of the operator of the mail preparation system is required except removing the jammed document or the envelope by hand.

Documents that are not intended for immediate insertion in an envelope are preferably passed to a separate deposition location before they reach the inserter station by operating a switch depending on the supply of a given main document, for instance when documents for private use or documents to be signed are involved. Periodically operating the switch depending on the supply of a given main document, so as to guide the main document to a separate deposition location, renders it unnecessary for the main documents to be manually separated from items prepared for despatch.

Preferably, an envelope that belongs to the main document that has been led to the separate deposition location is also led to that separate location. This makes it possible to fully prepare postal items except that the documents are still to be inserted into the envelope. After the desired manual operations, as signing, have been performed, all that needs to be done to make the items ready for despatch is to insert the main document with any further documents and enclosures in the envelope.

In accordance with an elaboration of the invention, the envelope may be left unmoistened and open, depending on the supply of a given main document, while at the same time a switch is operated for guiding the filled envelope to a separate deposition location. This makes it possible to periodically separate documents that are to undergo further manual operations after their being inserted into the corresponding envelope, from items that are to be dispatched without further processing. By separating the documents and the enclosures of an item to be mailed in the corresponding envelope, all elements of that item are reliably kept together.

When a conventional inserter station is to be used in which the envelope to be filled is passed from an envelope hopper to the inserter station, a printed envelope can be placed in the envelope hopper before an envelope is transported from the hopper to the inserter station. To that end the envelope hopper and the downstream portion of the envelope supply path that is connected thereto, are connected to a portion of the envelope supply path that is disposed upstream relatively to the envelope hopper and along which the printed envelopes coming from the printer can be supplied.

In order to process printed and unprinted envelopes in a random order, if so desired, periodically, a printed envelope coming from the printer or an envelope from the envelope hopper can be transported to the inserter station. As described hereinabove, the envelope hopper may be included in the envelope supply path or be connected to a portion of the envelope supply path which, before the inserter station, joins a portion of the envelope supply path that connects to the printer.

The invention also relates to a system for the preparation of postal items, in which periodically a main document is inserted into an envelope, which system comprises a printer, an envelope supply path and an inserter station connected to it.

For carrying out the method as referred to hereinabove, in a system of the type described above, in accordance with the invention, the printer is connected to the envelope supply path, in such a way that envelopes from the printer can be transported along the envelope supply path to the inserter station.

Through applying to an envelope a printing that corresponds to a given main document, a relationship is created associating that envelope with that given main document. By means of the system according to the invention, envelopes, after being printed, i.e. from the moment the relationship referred to is created, can be fed to the inserter station in a controlled manner. The relationship referred to can be maintained until the given main document is inserted into the corresponding printed envelope.

The transport path of the envelope supply path may be separated from the transport path of the document supply path. This offers the advantage that the envelope supply path may be of simple construction. Only the moment of supply of the printed envelope needs to be periodically coordinated with the moment of supply of the corresponding main document.

In accordance with an alternative embodiment, the printer is equipped both for printing envelopes and for printing main documents, and the envelope supply path, at least in part, is part of a common path for supplying both documents and envelopes. This embodiment makes it possible to print both the envelopes and the main documents using a single printer.

Through a switch the common path may branch off in the direction of transport into a document supply path and an envelope supply path, the switch being arranged directly upstream of the inserter station viewed in the direction of transport. Through the switch, envelopes and documents supplied can be passed to their respective places in the inserter station.

The location of the switch directly upstream of the inserter station permits a compact construction on account of the fact that the envelope and document supply path coincide over a relatively large distance. The sequence of envelopes and documents in the common path defines in a simple manner the relation between documents and the corresponding printed envelopes. The switch may be provided both in the inserter station or upstream of the inserter station viewed in the direction of transport.

In accordance with an alternative embodiment in which through a switch the common path branches off in the direction of transport into a document supply path and an envelope supply path, the switch is connected directly to the printer, the advantage being that apart from a short common path between the printer and the switch, the document supply path only needs to be equipped for passing through documents. This applies in particular to processing stations included in the document supply path, such as folding and inserter feed stations, and when the envelopes require a wider gauge than the documents, for instance when they are transported in transverse direction.

Preferably, the envelope supply path then comprises means for bringing the envelopes into and transporting them in a vertical position. Accordingly, the envelope supply path may be of very narrow construction. Moreover, in a vertical position the envelopes are flexible in a horizontal direction, which makes it easy for them to negotiate bends in a horizontal plane.

To maintain the relation between main documents and the corresponding printed envelopes when the operation of the system has been interrupted due to a blockage of a supply path and the system is restarted, it is advantageous to intercept an envelope or a document whose corresponding counterpart jammed. To that end the system may comprise a detection system for locating a main document or envelope corresponding to its jammed counterpart.

For the purpose of interception, an indication system may be provided for indicating the location of a main document or an envelope corresponding to a stuck envelope or a main document, which indication system is coupled to the detection system. On the basis of the position indicated by the indication system, the operator of the system can remove the corresponding document or envelope.

For automatically removing documents or envelopes corresponding with jammed envelopes or documents, when a common path is used which branches off directly before the inserter station into an envelope supply path and a document supply path, at least one divert path may be provided which through a switch is connected to the common path for supplying envelopes and documents, the switch being coupled to the detection system.

In accordance with an alternative embodiment, in which an exit path is connected to the inserter station, the divert path is connected to the exit path directly downstream of the inserter station, with the switch being coupled to the detection system. The advantage is that envelopes or documents which have reached the inserter station and which belong to jammed documents or envelopes, can automatically be removed by the system.

When using supply paths that have at least partly separated supply paths for envelopes and documents, a divert path may be connected to both the envelope supply path and the document supply path through a switch coupled to the detection system, for the purpose of removing envelopes or documents that belong to a corresponding jammed document or envelope.

For selecting main documents that are not to be directly inserted into an envelope, the system may comprise a switch included in the document supply path and a separate deposition location, which switch and location are connected by a document exit path, with the switch being automatically controlled depending on a given main document being supplied.

The envelope supply path may include a switch which is periodically and automatically controlled depending on a given document being supplied, with the switch and the separate deposition location being connected by an envelope exit path. The advantage is that it permits an envelope to be printed in accordance with the given main document which is not intended to be directly inserted into an envelope, and it permits the printed envelope to be diverted to the deposition location together with that main document.

For processing in a random alternation envelopes that are printed in accordance with given main documents supplied and envelopes that are not printed in accordance with given main documents supplied, the system may comprise an envelope hopper having a part of the envelope supply path connected to it, with the part of the supply path that connects to the envelope hopper and the part of the supply path that connects to the printer conjoining before the inserter station, viewed in the direction of transport.

In accordance with an alternative embodiment the envelope supply path includes an envelope hopper. The envelopes coming from the printer can then periodically be placed in the hopper in such a way that they are fed to the inserter station in a first-in-first-out order.

BRIEF DESCRIPTION OF THE DRAWING FIGURES

The invention will now be further explained and illustrated on the basis of a number of embodiments, with reference to the accompanying drawings, in which.

In the Figures like elements are designated by like reference characters.

Figure 1:
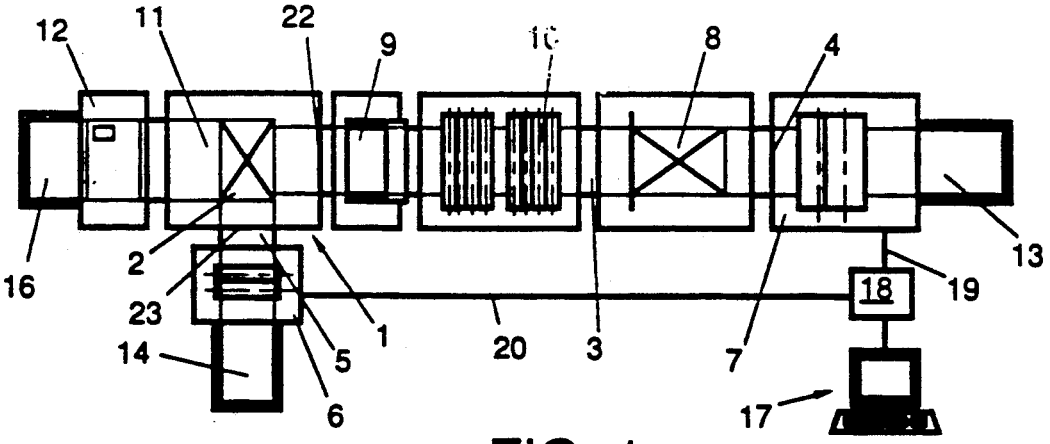
FIG. 1 is a schematic top plan view of an embodiment of a system according to the invention, and the coupling thereof to a data processor.

The embodiments shown each comprise an inserter system 1, comprising an inserter station 2 which is connected to a document supply path 3, which connects to a feeder station 4. Further, the inserter system 1 is connected to an envelope supply path 5, to which a printer 6 or 6/7 for printing envelopes is connected.

By means of envelope printer 6 or 6/7, the envelopes can be periodically printed depending on given main documents being supplied by the feeder station 4 along the document supply path 3, and are carried along the envelope supply path 5 to the inserter station 2. The transport of the envelopes and documents to the inserter station 2 is coordinated by the system in such a way that upon arrival at the inserter station 2, the printed envelopes are filled with the corresponding main documents.

In each envelope, one or more additional documents and enclosures may be inserted, in addition to a main document.

In the system shown in FIG. 1, the feeder station 4 comprises a printer 7 for preparing main documents by printing sheets. The document supply path 3 further comprises a collecting station 8, an insert feed station 9 and a folding station 10. To the feeder station 2 an exit path 11 is connected which includes a postage meter station 12. The printer 7 for printing sheets comprises a sheet container 13 for sheets to be printed, and the printer 6 for printing envelopes comprises an envelope hopper 14, in which envelopes to be printed can be placed. The document and the envelope supply paths 3 and 5 each extend through a separate entrance 22 and 23, respectively, of the inserter system 1. Connected to the postage meter station 12 is a delivery container 16. The two printers 6 and 7 are coupled to a data processing apparatus 17. For converting printing instructions coming from the data processing apparatus 17 into separate printing instructions for the two printers 6 and 7, a control unit 18 is interposed which is connected to those two printers by means of lines 19 and 20. The control unit 18 may also be connected to the inserter system 1 and each of the stations 4, 8, 9, 10, and 11 and the supply paths 3 and 5 for controlling the transport of envelopes and documents and for operating the inserter system 1 and one or more of the stations 4, 8, 9, 10 and 11, depending on the given main documents supplied. These connections are not shown in the drawings.

By means of the data processing apparatus 17 instructions for printing a main document can be drawn up as well as instructions for printing a corresponding printing on an envelope. By giving a command to prepare the postal item the instructions are applied to the control unit 18. The control unit 18, in turn, converts the instructions received to a communication with the printers 6 and 7, and, directly or indirectly, with the other stations 4, 8, 9, 10 and 11, the supply paths 3 and 5, and the inserter system 1. An envelope is taken from the envelope hopper 14, passed to the envelope printer 6 and there provided with a printing in accordance with the printing instructions drawn up by means of the data processing apparatus 17. Depending on the length of the main document once or more than once a sheet is taken from the sheet container and printed in accordance with the instructions drawn up by means of the data processing apparatus 17. After being printed, the envelope is passed via the envelope supply path 5 to the feeder station 2 and held there in such a way that the documents coming from the printer 7 and any enclosures added in the insert feed station 9 can be inserted into the envelope. The sheets can be passed along the document supply path 3 and may underway undergo known per se processes in the stations 8, 9, and 10 between the printer 7 and the inserter system 1. After arriving at the inserter station 2 the sheets and the enclosures added are inserted into the envelope held in readiness. Then the envelope is closed in the inserter system 1, sealed and transported to the postage meter station 12 via the exit path 11.

During the entire operation the envelopes and the sheets remain in the mail preparation system. The course of the envelopes and the sheets can be monitored by means of signals applied to the control unit 18. Postal items with addresses printed on the envelopes and involving different documents having to be dispatched to different addresses, can thus be prepared without any manual intervention. The preparation can be entirely controlled by means of the data processor and, if so desired, can be efficiently realized item by item.

Figure 2:
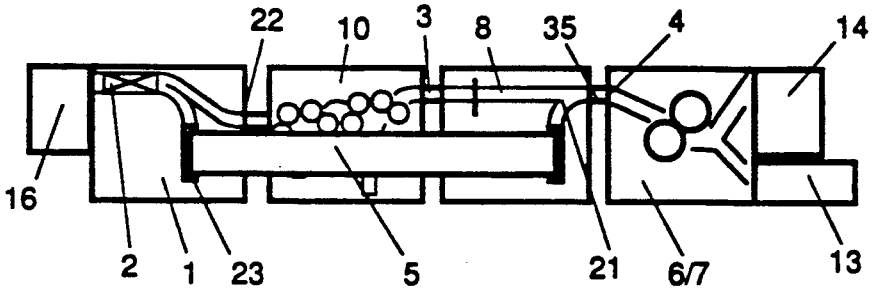
FIG. 2 is a schematic side view of a second embodiment.

The system according to the embodiment shown in FIG. 2 comprises a combined printer 6/7 for printing both sheets and envelopes. The envelope hopper 14 is connected to the combined printer 6/7. Viewed in the direction of transport, before the collecting station 8 a switch 21 is arranged for separating envelopes and documents. Upstream of the switch 21 the document and envelope supply path form a common supply path 35. After the switch 21 the document and envelope supply path 3 and 5 form separate transport paths each extending through a separate entrance 22 and 23, respectively, of the inserter system 1.

The envelopes are printed prior to or subsequent to the printing of the main documents. In the collecting station 8, by means of the switch 21, the documents and the envelopes are each passed into the corresponding paths 3 and 5, respectively, along which they are subsequently transported to the inserter system 1.

According to this embodiment, on the one hand, one printer 6/7 will suffice, and, on the other hand, except for providing a switch 21 for guiding the documents and the envelopes into the proper paths, no special measures are required for allowing the envelope to pass through stations which are interposed between the inserter system 1 and the printer 6/7.

Figure 3:
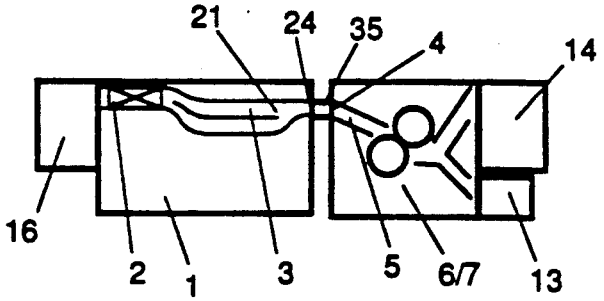
FIG. 3 is a schematic side view of a third embodiment.

FIG. 3 shows an embodiment of the invention in which the common supply path 35 extends into the inserter system 1. The inserter system has a single entrance 24 for both envelopes and documents. The switch 21 for guiding the envelopes and the documents into separate paths is included in the inserter system 1. After having passed the entrance 24 of the inserter system 1, documents and envelopes are scanned to establish if an envelope or a document is involved, and then passed to the corresponding location in the inserter station 2 by means of the switch 21, so that the envelope can be held open and the document can be inserted into that envelope.

Because the documents and the envelopes are successively transported along a common supply path 35, the order of arrival at the inserter station 2 is determined by the order in which they are supplied by the feeder station 4. Thus, maintaining the association between each main document and the corresponding envelope is ensured in a very reliable manner.

Figure 4:
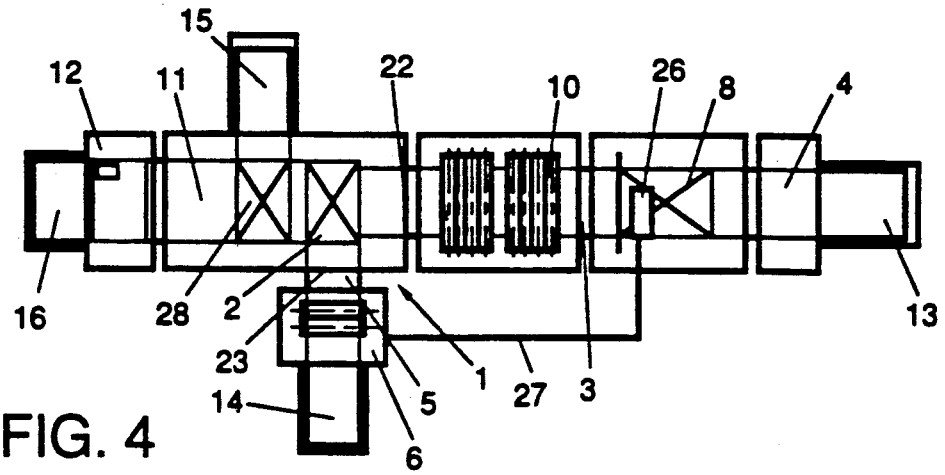
FIG. 4 is a schematic top plan view of a fourth embodiment.

FIG. 4 shows an embodiment in which the document supply path 3, at the collecting station 8, includes a copying window 26 through which a passing document can be scanned. The advantage of scanning at the collecting station 8 is that there an assembly which is to be dispatched in one envelope can be collected, an outermost sheet of the assembly having the address provided on a surface facing externally. When solely the address is to be printed on the envelope depending on the main document supplied, only a portion of the outermost surface referred to needs to be scanned. By exclusively scanning a portion of the surface where the address is provided, unnecessary scanning of sheets is avoided.

When the main documents are scanned, the scanned image is preferably converted into printing instructions which control the printer 6 in such a way that the printer prints an image on the envelope that is a representation of the scanned image. The printed envelope can then be passed to the inserter station 2, where the main document, a scanned portion of which is printed on that envelope, is inserted into that envelope. Because the printer 6 need not be coupled to an apparatus outside the mail preparation system, such as a data processing apparatus, no requirements are to be met as regards the compatibility of the envelope printer 6 with apparatus outside the system. Moreover, the system according to this embodiment of the invention is particularly suitable for inserting preprinted, mutually different main documents in envelopes to be printed in accordance with those main documents.

The embodiment of the invention shown in FIG. 4 further comprises a switching station 28, which is arranged in the exit path 11 which is connected to the inserter station 2. By means of these switches documents and envelopes whose corresponding counterparts have become jammed in the mail preparation system, are diverted to a removal container 15. The switching station 28 is preferably arranged, in the direction of transportation, before stations for closing and moistening the envelope (not shown). The switches referred to may also be arranged in the document supply path 3, the envelope supply path 5 or the common path 35 and may optionally serve for diverting documents that are not directly to be inserted into an envelope, or for diverting the corresponding envelopes.

We claim:

1. A method of preparing items to be mailed, comprising the steps of:

feeding an individual prefabricated envelope to a printer;

printing information that corresponds to a corresponding main document sheet on said envelope;

conveying said envelope from said printer to an inserter station;

holding said envelope in an opened condition;

feeding said document sheet from a printer at which information is printed on the document sheet to said inserter station, wherein information is printed on the envelope and on the document sheet through use of the same printer, the envelope and the document sheet being guided into separate paths at a point upstream of the inserter station with respect to the direction of feeding of the envelope, said envelope and document sheet being passed along the separate paths to the inserter station, said envelope and document sheet being guided into the separate paths directly before they are fed to the inserter station; and inserting said corresponding document sheet into said envelope.

2. The method according to claim 1, including the step of optically scanning markings on the document sheet, said scanned markings forming an image, and wherein said step of printing information on the envelope includes printing an image on the envelope that is substantially identical to at least a part of the image formed by the scanned image on the document sheet.

3. The method according to claim 1, wherein said envelope is transported in a vertical position.

4. The method according to claim 1, including the step of identifying the envelope that corresponds to a jammed document sheet or identifying the document sheet that corresponds to a jammed envelope.

5. The method according to claim 4, including the step of indicating the location of the identified envelope or the identified document sheet.

6. The method according to claim 4, wherein the method is carried out in a mail preparation system, and including the step of guiding the identified envelope or the identified document sheet to a location for removal from the mail preparation system.

7. The method according to claim 1, including the steps of operating a switch when a predetermined document sheet has been fed to thereby guide the predetermined document sheet to a separate deposition location before it reaches said inserter station, and guiding a printed envelope that corresponds to the predetermined document sheet to said deposition location.

8. The method according to claim 1, including the steps of leaving the envelope unmoistened and open after a predetermined document sheet is inserted therein, and operating a switch to guide the unmoistened and open envelope containing the predetermined document sheet to a separate deposition location.

9. The method according to claim 1, including the steps of transporting the envelope from an envelope hopper to the inserter station and placing a printed envelope in the envelope hopper prior to the transportation of an envelope from the envelope hopper to the inserter station.

10. A system for preparing items to be mailed in which a main document sheet is periodically inserted into an individual prefabricated envelope, said system comprising: a printer, an envelope hopper in which are placed envelopes to be printed, means for feeding individual envelopes from the envelope hopper to the printer, an inserter station at which a document sheet is inserted into a corresponding envelope, and an envelope supply path for supplying envelopes from said printer to said inserter station, said inserter station including means for holding an envelope in an opened condition, and inserter station being connected to said envelope supply path and to a document sheet supply path which supplies document sheets, said printer printing information on the document sheets and on the envelopes, said envelopes supply path and said document sheet supply path coinciding with one another for at least a portion of their length to define a common path for supplying both document sheets and envelopes; and said common path branching into the document sheet supply path and the envelope supply path at a switch, said switch being positioned directly prior to the inserter station as viewed in the direction of transport of the envelopes.

11. The system according to claim 10, wherein at least a portion of the document sheet supply path and said envelope supply path are separate from one another.

12. The system according to claim 10, including means for bridging the envelopes into a vertical position and for transporting the envelopes in the vertical position.

13. The system according to claim 10, including a detection system for locating an envelope that corresponds to a jammed document sheet or for locating a document sheet that corresponds to a jammed envelope.

14. The system according to claim 13, including an indication system operatively associated with the detection system for indicating the location of a document sheet located by the detection system or for indicating the location of an envelope located by the detection system.

15. The system according to claim 13, wherein said envelope supply path and said document sheet supply path coincide with one another for at least a portion of their length to define a common path, and including a divert path connected by way of a switch to the common path for supplying envelopes and document sheets, said switch being operatively associated with said detection system to remove a document sheet located by the detection system or to remove an envelope located by the detection system.

16. The system according to claim 13, including an exit path connected to the inserter station and a divert path connected to the exit path by way of a switch located directly after the inserter station with respect to the direction of movement of the envelopes, said switch being operatively associated with said detection system to remove a document sheet located by the detection system or to remove an envelope located by the detection system.

17. The system according to claim 13, wherein at least a portion of said document sheet supply path and said envelope supply path are separate from one another, and including a divert path that is connected to both the envelope supply path and the document sheet supply path by way of a switch, said switch being operatively associated with said detection system to remove a document sheet located by the detection system or to remove an envelope located by the detection system.

18. A system according to claim 10, including a first switch in said document sheet supply path, a document sheet divert path interconnecting said first switch and a separate deposition location, a second switch in said envelope supply path, an envelope divert path interconnecting said second switch and said separate deposition location, and control means operatively connected to said first and second switches for diverting a predetermined document sheet and a corresponding printed envelope.

19. The system according to claim 10, wherein a first portion of the envelope supply path is connected to an envelope hopper and a second portion of the envelope supply path is connected to the printer, the first and second portions of the envelope supply path merging with one another at a point prior to the inserter station as viewed in the direction of transport of the envelopes.

20. The system according to claim 10, including an envelope hopper arranged in the envelope supply path.

* * * * *